United States Patent [19]

Bernard

[11] Patent Number: 4,719,732

[45] Date of Patent: Jan. 19, 1988

[54] DRYWALL ATTACHMENT STRIPS

[76] Inventor: Andre Bernard, 5 Kitchel Rd., Mt. Kisco, N.Y. 10549

[21] Appl. No.: 77,505

[22] Filed: Jul. 24, 1987

[51] Int. Cl.[4] ..... E04F 13/06; E04F 19/02

[52] U.S. Cl. ..... 52/287; 52/309.1; 264/230; 264/DIG. 71; 156/85

[58] Field of Search ..... 52/277, 254, 278, 309.1, 52/417, 443; 264/DIG. 71, 230; 156/84, 85

[56] References Cited

U.S. PATENT DOCUMENTS

| | | | |
|---|---|---|---|
| 2,821,155 | 1/1958 | Seckel | 264/DIG. 71 |
| 2,995,784 | 8/1961 | Driscoll | 52/287 |
| 3,460,951 | 8/1969 | Heyl | 264/230 |
| 3,578,521 | 5/1971 | Evans | 154/84 |
| 3,844,861 | 10/1974 | Irish | 156/85 |
| 3,935,353 | 1/1976 | Doerfling | 296/31 P |
| 4,157,271 | 6/1979 | Moore | 52/417 |
| 4,172,745 | 10/1979 | Van Manen | 156/84 |
| 4,287,011 | 9/1981 | Derbyshire | 156/85 |
| 4,391,054 | 7/1983 | Schovee | 52/656 |
| 4,595,544 | 6/1986 | Maruyama | 264/DIG. 71 |

*Primary Examiner*—John E. Murtagh

[57] ABSTRACT

A covering over the 90 degree corner of gypsum or plasterboards which rounds the corner to a small radius and thus provides a desirable commercial appearance thereto, which uses heat shrinkable tape to fuse the covering in place and also, as a result of the shrinkage, cause the removal of any wrinkles therein as might otherwise undermine the objective of the covering.

4 Claims, 9 Drawing Figures

DRYWALL ATTACHMENT STRIPS

The present invention relates generally to improvements for drywall construction, wherein more particularly the improvements enhance the appearance of the corner of attached gypsum or plasterboards.

The rounding off of the 90 degree corner of plasterboards, the objective of numerous U.S. prior patents, as for example Dunlap, U.S. Pat. No. 2,687,558, issued on Aug. 31, 1954, achieves the objective sought, but at the expense of requiring a significant number of additional finishing materials and the handling thereof. Thus, in Dunlap, which is typical, a roundshape presenting object, namely a round wooden rod, is taped in place over the corner and receives an application of putty to cover over, and thus round off, the sharp or line edge of the plasterboard corner. Any less effort to finish the appearance of the corner apparently has heretofore not produced the commercial appearance in the corner that is desired.

Broadly, it is an object of the present invention to provide a neat, rounded off, plasterboard corner, overcoming the foregoing and other shortcomings of the prior art. More specifically, it is an object to use heat responsive materials to finish the corner appearance, wherein the applied heat both attaches and assures a desirable proper appearance in the materials used, so that the end result being sought, namely a neat appearing corner, is correspondingly provided by the neat-appearing materials being used to form the corner.

More particularly, in connection with drywall construction in which a pair of edge-abutting plasterboards form a corner, an attachment thereto for rounding off said corner demonstrating objects and advantages of the present invention includes an extrusion, cut to the vertical size of the corner, and having in cross section an L-shape to thereby present from their connection a pair of outwardly diverging arms. The selected extrusion is of plastic construction material having a requisite resiliency for permitting limited flexing in the position of said arms, and has, of course, a specified melting temperature. Combined with the extrusion is a heat-shrinkable plastic tape disposed in covering relation along one side of the extrusion and of a size in its width to present, when said extrusion is centered thereon, opposite side portions extending beyond the extrusion. In use, the tape and extrusion have an operative position in which the arms of the extrusion are disposed in straddling relation over the plasterboard corner, and the tape is in a covering relation thereover with its opposite side portions in contact with the plasterboard beyond said extrusion. In this operative position, and in response to the application of heat against the tape, at a temperature below the specified melting temperature of the extrusion but above the shrinking temperature of the tape, the tape undergoes shrinkage and fuses itself in attached relation to the plasterboard. The simultaneously occurring tape shrinkage results in the removal of any wrinkles therefrom and in the urging of the resilient arms of the extrusion through flexing movement, which conforms the shape provided by the arms to the corner shape of the plasterboards, and thus provides a neat, rounded off, corner.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein.

Figure 2A:
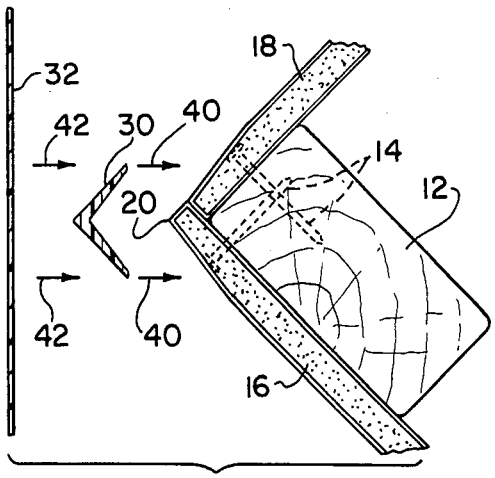
FIG. 2A is a second embodiment of the invention, in which more particularly, the components are disassembled.
Figure 2B:
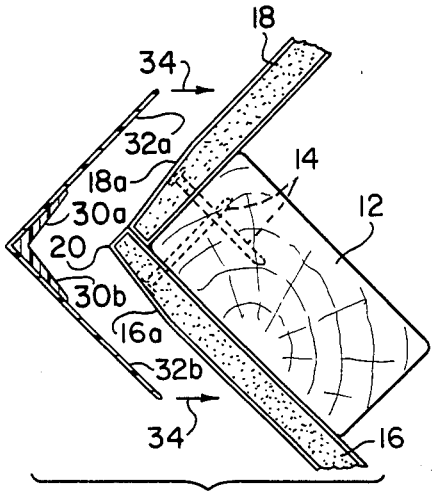
FIG. 2B is a view similar to FIG. 2A, but illustrates the first embodiment of FIG. 1, as seen in section along line 2—2 of FIG. 1.
Figure 3:
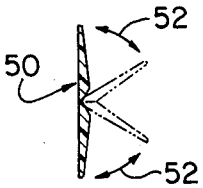
Figure 3A:
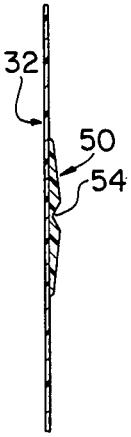
Figure 3B:
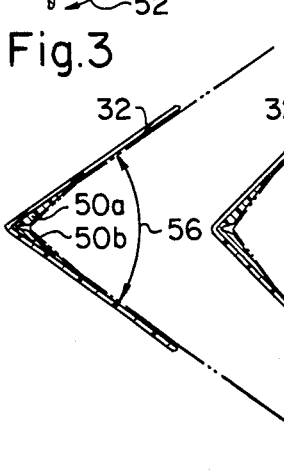
Figure 3C:
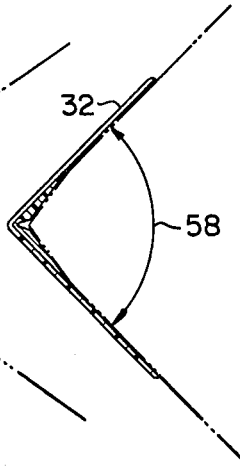
Figure 3D:
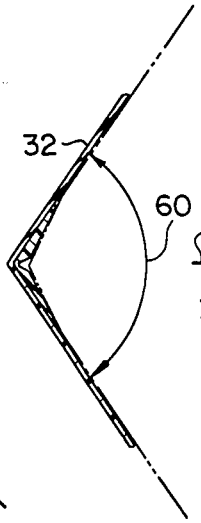
Figure 2C:
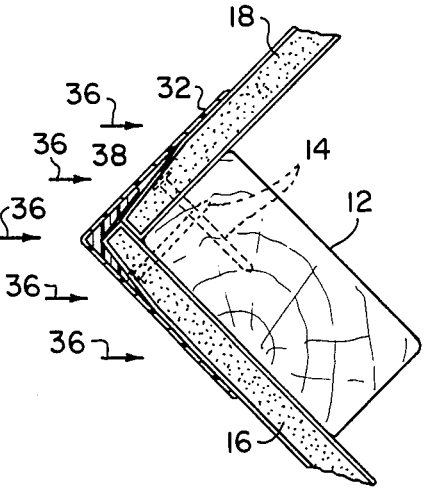

In the vertical alignment of FIGS. 2A and 2B, there is FIG. 2C which is a plan view applicable to both the embodiments of FIGS. 2A and 2B and illustrates how these embodiments provide a finished corner appearance in accordance with the present invention;

FIG. 3 is a sectional view of one of the components of the invention, namely, a plastic extrusion;

FIGS. 3A, 3B, 3C and 3D are sectional views illustrating how the extrusion of FIG. 3 is applied to the other component of the invention, namely, a heat fusable tape, and how the extrusion, starting from a flat configuration as in FIG. 3A undergoes flecturing movements as illustrated in FIGS. 3B–3D.

At the corners in drywall constructions it is not particularly desirable to leave a sharp edge and accordingly, and as exemplified by prior U.S. Pat. No. 2,687,558 issued on Aug. 31, 1954 to A. H. Dunlap, various attachments are used to "round off" the corner. While in accordance with the present invention this "rounding off" is to a rather small radius, whereas in the referred to Dunlap patent, the rounding off is to a significantly greater radius, the objective is nevertheless essentially the same in that a corner that comes to a line edge is to be avoided.

Figure 1:
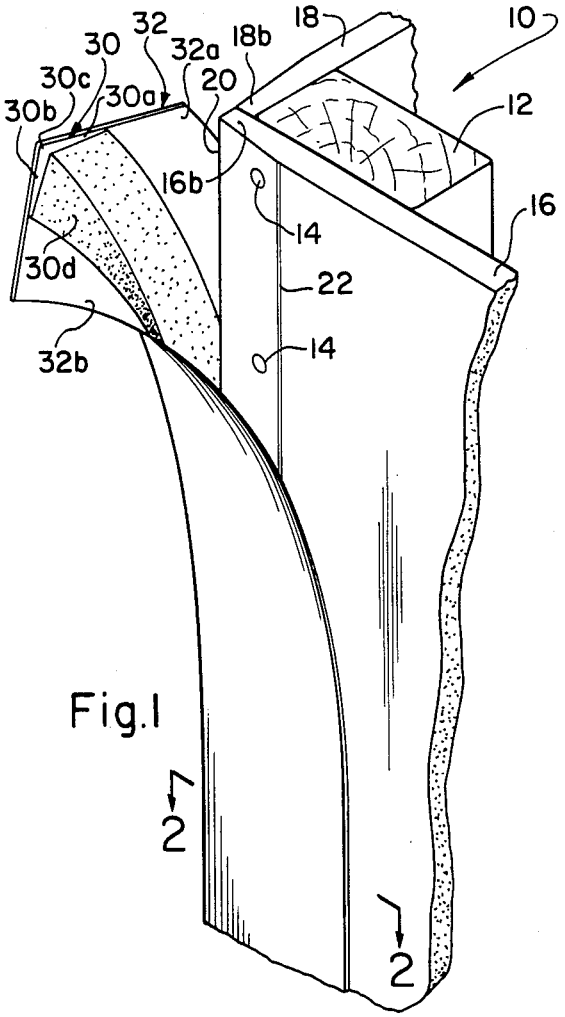
FIG. 1 is an isometric view of a first embodiment of the corner-finishing attachment of the present invention.

Shown in FIG. 1 is a typical drywall construction to which the inventive attachment is advantageously applied. Said construction, generally designated 10, includes a vertical stud 12, to which has been nailed, as at 14, gypsum or plasterboards 16 and 18 which form a corner 20 which if not finished would present a 90° corner edge or thin line. The edges of the board 16 and 18, as is customary, is of slightly reduced thickness starting at the locations 22.

FIGS. 1 and 2B illustrate a first embodiment of the within invention in which the two components which provide a finish or small radius curve to the corner 20 are in an assembled condition. One component is a plastic extrusion 30 which in cross section has an L-shape and thereby presents a pair of arms **30*a* and 30*b* which extend outwardly from their vertical connection 30*c*. The other component is a heat-shrinkable tape 32 which has a width that is selectively larger than the width of the extrusion 30 so as to present a pair of peripheral portions 32 and 32*b* which extend beyond the arms 30*a*, 30*b*. In this first illustrated embodiment, the extrusion 30 is adhesively secured centrally along the tape 32** and in this respect, therefore, the two components are in an assembled condition.

An option available also is to apply an adhesive layer, designated **30*d*, to the exposed surface of the extrusion 30, which adhesive layer, as will be more apparent as the description proceeds, assists in bonding the corner finishing attachment about the corner 30*d*. However, the adhesive layer is not necessary and can be omitted since the extent of attachment necessary to achieve the purposes of the invention is provided by the fusing attachment of the tape portions 32a and 32b to the plasterboards 16 and 18**, as will be described in greater detail subsequently.

Progressive review of FIG. 1 and FIG. 2B illustrate the position of the tape 32 and extrusion 30, wherein closing movement 34 places the arms 30a and 30b in what can be aptly termed a straddling condition, with the laterally extending tape edge portions 32a and 32b in contact with an underlying front surfaces 16a and 18a of the board 16 and 18 respectively. Both the extrusion 30 and tape 32 have their largest dimension in a lengthwise orientation and it is therefore contemplated that they will be cut to an appropriate length as dictated by the vertical dimension of the corner 20, necessary to serve as a cover for the corner 20.

Reference should now be made to FIG. 2c which illustrates the final step in carrying out the invention, which is, of course, attaching the extrusion 30 and tape 32 in covering relation over the corner 20. As illustrated in FIG. 2c, the assembly of the extrusion 30 and tape 32 can be manually held against the corner 20, or temporarily taped (not shown) in the illustrated position, and thereafter, and using an ordinary hot-air blower of the tape used for hair grooming, a stream of hot air, designated by the arrows collectively designated 36, is directed against the exposed surface of the tape 32. Since the tape is of a heat-shrinkable plastic construction material, the impingement of the hot air 36 against its external surface has several significant consequences. First, it raises the temperature of the tape to a range at which it undergoes shrinkage, in accordance with a well understood phenomenon, and this removes any surface wrinkles from the tape, which is not removed, would provide an undesirable wrinkled appearance, since a wrinkled appearance would undermine the essential object which is to provide a finished appearance to the corner 20.

Second, the heated up tape 32 becomes tacky and adhesive, and thus the surfaces 32a and 32b which are in contact with the plasterboards 16 and 18 fuse themselves to these plasterboards and thus achieve a firm attachment to these boards.

The tape also undergoes a dimensional change from a larger to a smaller size and this applies an external force against the plastic extrusion 30 which, if need be, would urge the arms 30a and 30b through appropriate flexing movement that would thus enable the arms 30a and 30b to conform to the precise shape of the corner 20. This conforming in shape together with the fact that the triangular arms 30a and 30b are larger at their bases which coincide with their connection 30c combine to provide a rounded configuration, even though a line-like corner 20 is provided by the plasterboard 16 and 18.

Also, and as best illustrated in FIG. 2c, the flexing and the conforming in shape of the arms 30a and 30b keep to a minimum any voids, such as that designated 38, between the tape and the plasterboards.

Reference should now be made to FIG. 2A which illustrates another embodiment of the within invention. This is classified as another embodiment because the extrusion 30 and the tape 32 can be applied in covering relation over the corner 20 without previously being assembled to each other. Thus, as illustrated in FIG. 2A, the extrusion 30 is placed, as per the arrows 40, over the corner 20 and is then followed by the placement of the tape 32 in covering relation thereover. The attachment of these components is then achieved in the manner already described in connection with FIG. 2C.

A third contemplated embodiment is illustrated in FIG. 3, wherein the extrusion designated 50, has an initial flat configuration, but the plastic construction material has sufficient pliability so that it can be moved in opposite directions 52 between the full line and phantom line positions illustrated.

As shown in FIG. 3A, the extrusion 50 has a V-shaped notch 54 provided centrally thereof which defines a central fold line about which the opposite arms of the extrusion 50 partake of the flexing movement 52. Thus, starting from an initial flat configuration in which it is adhesively secured to a heat-shrinkable tape such as that previously described and designated 32, the extrusion 50 can be flexed into a variety of selected angles subtended by its arms 50a and 50b. These different subtended angles are designated 56, 58 and 60 in FIGS. 3B, 3C and 3D, respectively.

As is well understood, the temperature of operation of a hot air blower is typically in the range of between 115° to 150° which usually well below that which causes deformation or melting in extrudable vinyl plastics, such as noted in Moore, U.S. Pat. No. 4,157,271 issued June 5, 1979 which it will be understood is the preferred construction material for the extrusion 30. However, the above noted conventional temperature range of a hot air blower is in a range which causes shrinkage in heat-shrinkage film, such as the film noted in my prior U.S. Pat. No. 4,632,790 issued on Dec. 30, 1986, which is the preferred construction material for the tape 32.

From the foregoing it should be readily appreciated that there has been described herein an attachment that can be readily applied over the corner of edge-abutting plasterboards, such as the abutting edges 16b and 18b of FIG. 1, and which attachment provides a finished and more commercially acceptable appearance to the corner which is formed by these boards.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. For attachment in drywall construction to a pair of edge-abutting plasterboards forming a corner, the improvement for rounding off said corner comprising an extrusion, cut to the vertical size of said corner, having in cross section an L-shape to thereby present from their connection a pair of outwardly diverging arms, said extrusion being of plastic construction material having resiliency for permitting limited flexing in the position of said arms, and having a specified melting temperature, and a heat-shrinkable plastic tape disposed in covering relation along one side of said extrusion and of a size in its width to present, when said extrusion is centered thereon, opposite side portions extending beyond said extrusion, said tape and extrusion having an operative position in which said arms of said extrusion are disposed in straddling relation over said plasterboard corner and said tape is in said covering relation thereover with said opposite side portions in contact with said plasterboard beyond said extrusion, whereupon in response to the application of heat against said tape, at a temperature below said specified melting temperature of said extrusion and above said shrinking temperature of said tape, said tape undergoes shrinkage and fuses itself in attached relation to said plasterboard, said shrinkage resulting simultaneously in the removal of any wrinkles therefrom and in the urging of said resilient arms of said extrusion through flexing movement which conforms the shape provided by said arms to the corner shape of said plasterboards.

2. A corner finishing attachment for a drywall construction as claimed in claim 1, wherein said extrusion is adhesively secured centrally of said heat-shrinkable tape.

3. A corner finishing attachment for a drywall construction as claimed in claim 2, wherein said extrusion on its opposite surface has an adhesive layer which is rendered adhesively tacky upon the application of said heat to said tape.

4. A corner finishing attachment for a drywall construction as claimed in claim 2, wherein said extrusion is in an initial flat configuration and has a central V-shaped notch to define a fold line therealong, whereby the arms can be closed along said fold line to subtend any selected angle therebetween to conform to the angle and thereby facilitate providing a finished appearance to said corner.

* * * * *